United States Patent [19]

Sloan

[11] Patent Number: 4,971,471

[45] Date of Patent: Nov. 20, 1990

[54] DISPOSABLE MOP

[76] Inventor: David B. Sloan, 6720 Aspen La. #4, Westmont, Ill. 60559

[21] Appl. No.: 462,865

[22] Filed: Jan. 5, 1990

Related U.S. Application Data

[63] Continuation of Ser. No. 241,483, Sep. 7, 1988, abandoned.

[51] Int. Cl.[5] ..... A46B 11/04; A47L 13/312

[52] U.S. Cl. ..... 401/203; 15/210 R; 15/228; 401/289

[58] Field of Search ..... 401/139, 140, 132, 196, 401/203, 204, 205, 207, 261, 263, 265, 266, 268, 270, 271, 279, 280, 282–289; 15/24, 29, 104, 93, 94, 147 R, 147 A, 209 R, 221, 228, 229.3, 244.1–244.4

[56] References Cited

U.S. PATENT DOCUMENTS

| | | | |
|---|---|---|---|
| 1,091,888 | 3/1914 | Lorzing . | |
| 2,211,275 | 8/1940 | Lachapelle . | |
| 2,237,793 | 4/1941 | Rudd | 401/203 |
| 2,262,166 | 11/1941 | Cooley | 401/203 X |
| 2,307,858 | 1/1943 | Rufo . | |
| 2,537,784 | 1/1951 | Nord | 15/147 R X |
| 2,601,689 | 7/1952 | Mallard . | |
| 2,904,812 | 9/1959 | Lee . | |
| 2,922,425 | 1/1960 | Lerner et al. . | |
| 2,969,626 | 1/1961 | Rudes | 401/196 |
| 3,089,181 | 5/1963 | Hess . | |
| 3,099,035 | 7/1963 | Plost . | |
| 3,099,855 | 8/1963 | Nash | 15/244.2 X |
| 3,105,987 | 10/1963 | Riedi | 401/196 X |
| 3,161,905 | 12/1964 | Dryden . | |
| 3,258,809 | 7/1966 | Harvey . | |
| 3,331,090 | 7/1967 | Reiber et al. . | |
| 3,333,293 | 8/1967 | Skurdelis | 401/196 |
| 3,359,591 | 12/1967 | McGuire . | |
| 3,384,438 | 5/1968 | Sherbondy . | |
| 3,403,959 | 10/1968 | Holderman . | |
| 3,485,562 | 12/1969 | Hidden et al. | 401/196 X |
| 3,611,468 | 10/1971 | Michael | 15/244.3 X |
| 3,635,567 | 1/1972 | Richardson Jr. | 401/132 |
| 3,699,980 | 10/1972 | Carpenter . | |
| 3,713,744 | 1/1973 | Sims . | |
| 4,057,353 | 11/1977 | Kitatani . | |
| 4,119,386 | 10/1978 | Cushing . | |
| 4,152,084 | 5/1979 | Melton et al. | 401/285 X |
| 4,236,840 | 12/1980 | Kennedy . | |
| 4,415,288 | 11/1983 | Gordon et al. . | |
| 4,515,840 | 5/1985 | Gatward | 428/35 |
| 4,629,347 | 12/1986 | Poppitz . | |

*Primary Examiner*—Richard J. Johnson

*Attorney, Agent, or Firm*—Willian, Brinks, Olds, Hofer, Gilson & Lione

[57] ABSTRACT

A mop assembly is provided for the continuous application of wax and cleaning fluids which utilizes a detachable, disposable plenum incorporated into a disposable sponge mop. The disposable plenum has a plurality of substantially uniformly-spaced openings which provide for a substantially uniform distribution of fluid entering into the sponge. The disposable mop also has a substantially impermeable backing layer which shields the mop head and other non-disposable parts from wax, cleaning fluid, and residue present in the sponge. The disposable mop eliminates the problems associated with clogging of the openings in the non-disposable plenums currently in use, and substantially reduces the amount and frequency of required cleaning of the mop head and other non-disposable parts.

19 Claims, 2 Drawing Sheets

DISPOSABLE MOP

This application is a continuation, of application Ser. No. 07/241,483, filed Sept. 7, 1988, abandoned.

FIELD OF THE INVENTION

The present invention relates to an improved disposable mop head for use in the application of waxes and other floor maintenance liquids.

BACKGROUND OF THE INVENTION

Traditionally, waxes and other floor maintenance liquids have been applied by dipping a sponge or string mop in a bucket of liquid, wringing out the mop using a wringer connected to the side of the bucket, and then moving the mop back and forth across the floor. After the mop dispensed some of its retained liquid or became dirty, it was again dipped into the bucket of liquid. This method had three major disadvantages. First, it was difficult to obtain an even distribution of floor maintenance liquid because the wetness of the mop varied with the extent of wringing out and with the amount of time lapsed since the mop had been last dipped into the bucket. Second, the liquid in the bucket was repeatedly exposed to dirt from the mop and had to be discharged and replaced frequently. Finally, the mop itself had to be cleaned frequently in order to obtain and maintain clean floors.

When the desired operation involves scrubbing, the foregoing problems have been solved to some extent by providing brushes having a plurality of substantially evenly spaced openings in the brush head through which liquid may be supplied in a substantially uniform fashion. The liquid is supplied in a continuous fashion from a reservoir or other source which is connected to the head or handle of the brush. Examples of such brush designs are disclosed in U.S. Pat. No. 4,629,347, U.S. Pat. No. 4,236,840, U.S. Pat. No. 4,057,353, and U.S. Pat. No. 1,091,888.

Efforts have also been made to supply sponge mops continuously and evenly with waxes or other liquids by providing a plenum or sponge head having a plurality of substantially evenly spaced openings which feed fluid into the sponge. Examples of such sponge devices are disclosed in U.S. Pat. 4,119,386, U.S. Pat. No. 4,057,353, U.S. Pat. No. 3,713,744, U.S. Pat. No. 3,359,591, U.S. Pat. No. 3,258,809, U.S. Pat. No. 3,099,035, and U.S. Pat. No. 2,601,689.

The primary disadvantage of the foregoing brush and sponge devices is that the substantially evenly spaced openings become clogged with dirt or other residue, thereby preventing an even distribution of wax or cleaning fluid from occurring. Cleaning of these openings and of the entire mop head requires much time and inconvenience and often requires disassembly of the mop head. The mop head must be cleaned not only when the fluid feed openings become clogged but also whenever the mop assembly is to be stored between uses and whenever different fluids are to be applied using the mop assembly. Furthermore, many of these devices utilize mop heads which are complex, heavy and cumbersome due to the location of the fluid reservoir inside or above the mop head. These mop heads are difficult to maneuver into narrow spaces and corners.

SUMMARY OF THE INVENTION

The present invention alleviates many of the foregoing problems by providing a disposable mop assembly which includes, as part of the mop assembly, a disposable plenum having a plurality of substantially evenly spaced openings for distributing liquid into a sponge. The disposable plenum is positioned between a sponge layer and a layer of a material which is substantially impermeable to wax and cleaning liquids. The plenum is connected to a liquid supply line by means of a tubular portion which extends upward through openings in the substantially impermeable layer, a backing layer for the disposable mop, and a mop holder. The backing layer, which is preferably made of paper, plastic, or another suitable flexible material, is sewn along its edge to a cloth layer which covers the front (lower portion) of the sponge such that the sponge layer, the plenum, and the substantially impermeable layer are enclosed between the backing layer and the cloth layer.

The disposable mop is connected to a mop head assembly, preferably constructed of plastic, using an adhesive or other suitable means for fastening the backing layer of the disposable mop to a lower surface of the mop head. The tubular portion of the plenum extends upward through the mop head where it is connected to a liquid supply line which is preferably constructed of a plastic tubing. The liquid supply line is connected to a reservoir which is preferably located remote from the mop but which can alternatively be attached to the mop handle or to the mop head. In a preferred embodiment, the reservoir is positioned inside a backpack which can be carried around on the user's back. A valve assembly is provided in the liquid supply line for regulating the flow of liquid from the reservoir to the disposable mop assembly.

The foregoing and other embodiments of the invention are explained more thoroughly in the following Detailed Description made with reference to the accompanying figures.

DETAILED DESCRIPTION OF THE PREFERRED EMBODIMENTS

Figure 2:
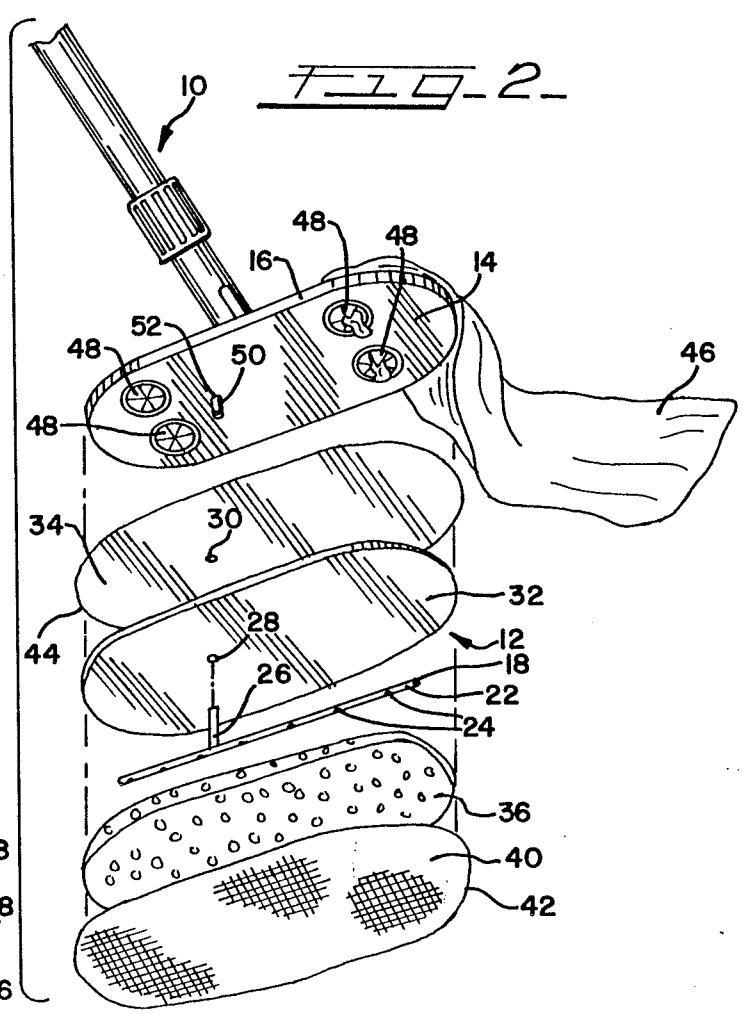
FIG. 2 is an exploded perspective view of the disposable mop and the bottom surface of the mop head.
Figure 1:
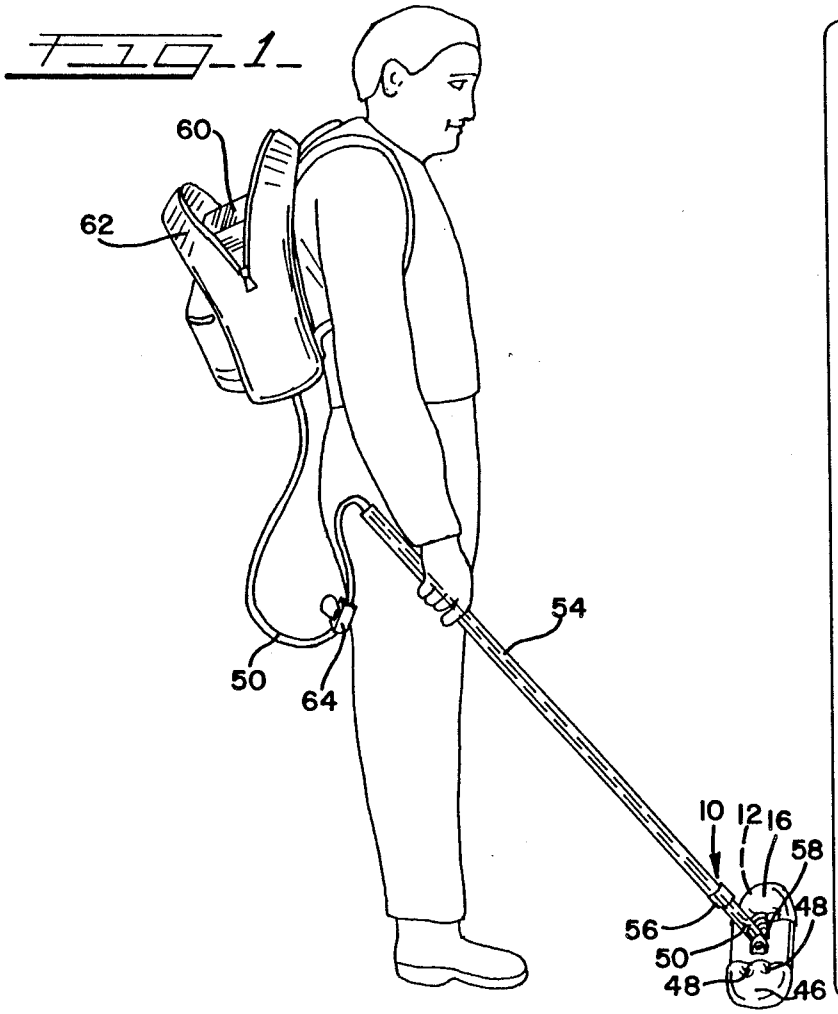
FIG. 1 illustrates the positioning of the mop assembly of the invention during use.
Figure 4:
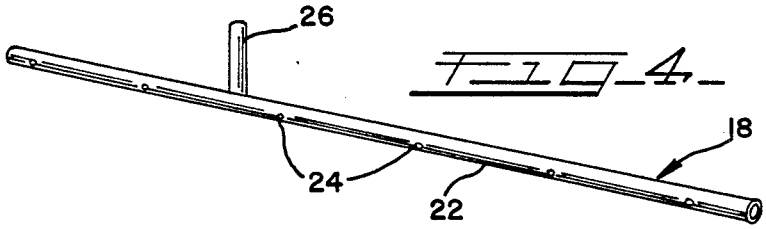
FIG. 4 is a perspective view of the disposable plenum.

Referring first to FIG. 1, 2 and 4, the mop assembly 10 of the invention includes a disposable mop 12 connected to a lower surface 14 of a mop head 16 using an adhesive, hook and loop type fasteners (e.g. VELCRO strips) tape, or another suitable fastening means. The disposable mop 12 includes a disposable plenum 18 preferably constructed of high density polyethylene or another suitable inexpensive material. The disposable plenum 18 has a long tubular portion 22 extending over most of the length of the disposable mop 12, in which a plurality of substantially uniformly spaced openings 24 are formed. A short tubular portion 26 is connected to the long portion 22 in a substantially perpendicular fashion.

The short portion 26 extends upward through openings 28 and 30 located in a substantially impermeable layer 32 and a backing layer 34, respectively. By "substantially impermeable", it is meant that waxes, cleaning fluids and dirt will not penetrate the layer 32 in an upward direction, thereby eliminating the need for repeated cleaning of the mop head 16 and other non-disposable portions of the mop assembly 10 between uses. The substantially impermeable layer 32 may be formed from closed cell polyethylene foam, vinyl film, rubber sheeting, or another suitable material. The backing layer 34 may be formed from paper, cloth, thin plastic, or another suitable material and may include, on its top side (not shown), an adhesive, hook and loop type fasteners (e.g. VELCRO strips) or another suitable means for fastening the disposable mop 12 to the lower surface 14 of the mop head 16.

Wax or cleaning fluid enters the disposable plenum 18 through the short portion 26 and flows lengthwise along the long portion 22 and through the substantially uniformly spaced openings 24 to cause a substantially even distribution of fluid to be applied to the sponge layer 36. The sponge layer 36 may be formed from any suitable sponge material including cotton, polyurethane foam, cellulose sponge or synthetic fibers. The wax or cleaning fluid which is applied to the sponge layer 36 passes through the sponge layer 36 and through a lower layer 40 whereby the fluid is applied to the floor in a substantially uniform fashion. The lower layer 40 is formed of a porous material, such as a porous cloth. The lower layer 40 is joined to the backing layer 34 along or near the outer edges 42 and 44, respectively, such as to enclose the substantially impermeable layer 32, the disposable plenum 18, and the sponge layer 36 between the lower layer 40 and the backing layer 34.

The disposable mop 12 (including the backing layer 34, the lower layer 40, and the components enclosed therebetween) eliminates the task associated with prior art devices of cleaning a non-disposable plenum both between uses and whenever the openings in the plenum became clogged with dirt or other residue. Furthermore, as previously stated, the substantially impermeable layer 32 positioned above the plenum 18 protects the mop head 16 from wax, cleaning fluids, and dirt present in the sponge layer 36. This feature substantially eliminates the need for cleaning the mop head and the other non-disposable parts.

An optional protective cloth 46 may be attached to the mop head 16 and wrapped around the disposable mop 12 during use to increase its useful life. The protective cloth 46, which is also disposable, reduces the amount of dirt which penetrates into the disposable mop 12. Because the protective cloth 46 is much less expensive than the disposable mop 12, it can be replaced much more frequently. In the embodiment shown, the protective cloth 46 is fastened to the mop head 16 by stuffing the corners of the cloth 46 into the slitted plastic openings 48 provided in the mop head 16 as shown in FIGS. 2 and 5.

Figure 3:
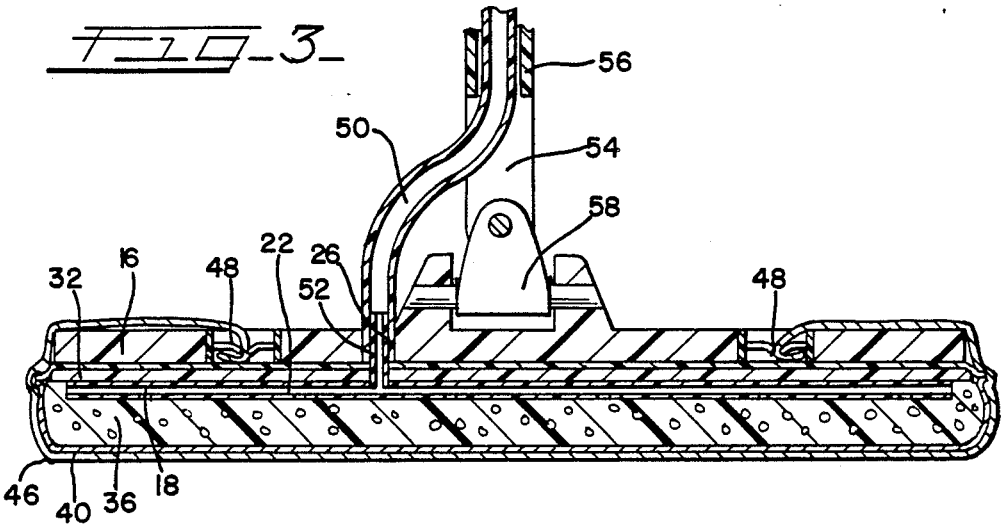
FIG. 3 is a sectional view of the disposable mop and the bottom surface of the mop head.
Figure 5:
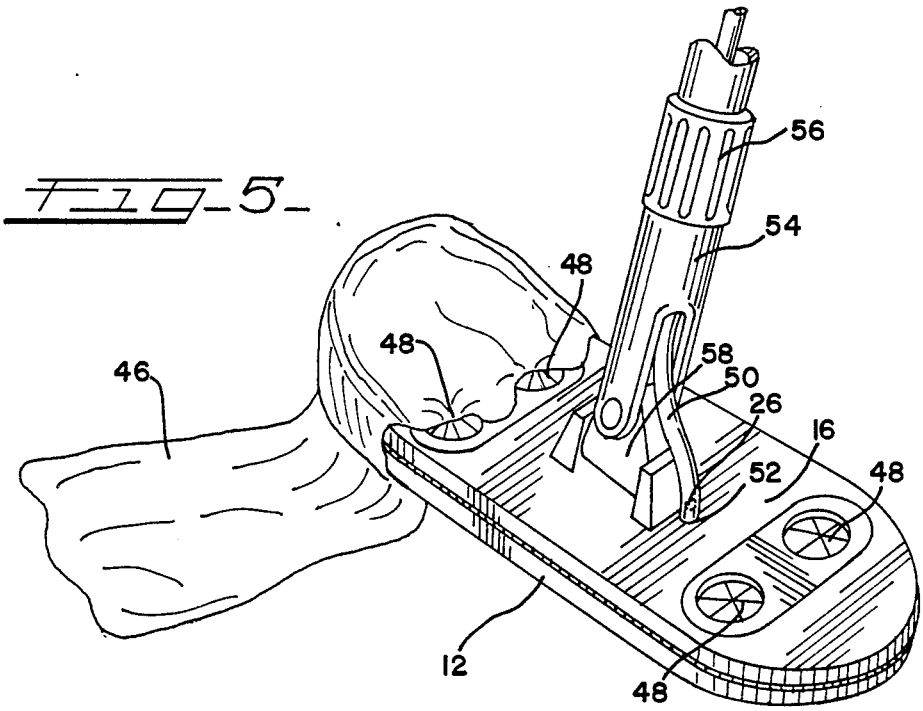
FIG. 5 is a top perspective view of the disposable mop and the mop head.

Referring now to FIGS. 3 and 5, the short tubular portion 26 of the disposable plenum 18 is detachably connected to a fluid supply line 50 in the vicinity of an opening 52 in the mop head 16. The fluid supply line 50, which is preferably formed from Tygon rubber or flexible plastic tubing, passes through the inside of a long, preferably tubular mop handle 54. The mop handle 54 is preferably connected to the mop head 16 using a universal double swivel joint assembly 58. The double swivel joint assembly 58 provides for movement of the mop handle relative to the mop head in all directions. The fluid supply line 50 may itself be disposable, such that different fluid supply lines can be used for the application of different fluids. The mop handle 54 may be segmented in order to facilitate easy replacement of the fluid supply line 50. The different segments may be joined using hand-removable fittings as shown at 56. The mop handle 54, mop head 16, and double swivel joint assembly 58 are preferably constructed from a rigid plastic material, though other suitable materials may also be employed.

Referring again to FIG. 1, the wax or cleaning fluid may be supplied from a reservoir 60, such as a plastic 2½ gallon jug, which is carried inside a backpack 62 mounted on a person's back. Other containment means (not shown) for the fluid are also possible. The fluid may, for example, be supplied from a reservoir which is connected either to the mop handle or the mop head. Alternatively, the fluid reservoir may be located remote from the mop (e.g., in a corner of the room or hanging from a wall). The primary advantage of the embodiment shown is that it allows the fluid reservoir to "travel" with the user without adding extra weight or size to the mop handle or mop head. This embodiment facilitates easier maneuvering of the mop assembly and, in particular, facilitates easier maneuvering of the mop into narrow spaces and corners.

A valve assembly 64 is provided on the fluid supply line 50 for regulating the flow of fluid from the reservoir 60 to the disposable plenum 18 of the disposable mop 12. When the supply line 50 is constructed of Tygon rubber or flexible plastic tubing, the valve assembly 64 preferably consists of a stopcock valve.

While the embodiments of the invention disclosed herein are presently considered to be preferred, it is understood that the invention is not limited to the disclosed examples. Modifications in addition to those discussed can be made without departing from the invention. For example, the substantially impermeable layer may itself serve as a backing layer. Furthermore, the components of the disposable mop can be made detachable from one another allowing, for example, for replacement of the lower sponge portion individually. Different methods for fastening the layers of the mop together may also be utilized The scope of the invention is indicated in the appended claims, and all changes that come within the meaning and range of equivalency of the claims are intended to be embraced therein.

I claim:

1. A disposable mop comprising:

a first layer comprising a sponge material, a second layer comprising a material which is substantially impermeable to waxes and cleaning fluids;

a disposable plenum between the first and second layers having a plurality of openings for distributing fluid into the sponge material;

a backing layer adjacent to the substantially impermeable layer; and a layer positioned such that the sponge material layer is between the cloth material layer and the plenum of cloth material adjacent to the sponge material layer;

the layers being joined at respective edges of the layers such that the substantially impermeable layer, the plenum and the sponge material layer are substantially enclosed between the backing layer, said layers and said plenum forming a unitary disposable assembly and the cloth material layer.

2. The disposable mop of claim 1 wherein the sponge material comprises polyurethane foam.

3. The disposable mop of claim 1 wherein the sponge material comprises cotton.

4. The disposable mop of claim 1 wherein the substantially impermeable layer comprises closed cell polyethylene foam.

5. The disposable mop of claim 1 wherein the disposable plenum comprises a long tubular portion having said plurality of openings positioned substantially uniformly along its length and a short tubular portion about perpendicular to the long tubular portion for connection to a fluid supply line, said short tubular portion extending upward through an opening in said second layer.

6. The disposable mop of claim 1 wherein the substantially impermeable layer and the backing layer comprise an integral unit.

7. The disposable mop of claim 1 wherein the backing layer comprises a flexible plastic material.

8. The disposable mop of claim 1 wherein the backing layer comprises paper.

9. The disposable mop of claim 1 further comprising an adhesive layer for fastening the disposable mop to a mop head.

10. The disposable mop of claim 1 further comprising a removable, disposable protective cloth for providing limited protection from dirt.

11. A mop assembly for distributing fluid in a substantially continuous fashion comprising:

a mop handle;

a mop head;

means for connecting the mop handle to the mop head allowing movement of the mop head relative to the mop handle;

a disposable mop connected to the mop head comprising a first layer of sponge material, a second layer of material which is substantially impermeable to waxes and cleaning fluids, a disposable plenum between the first and second layers having a plurality of openings for distributing fluid into the sponge material, a backing layer adjacent to the substantially impermeable layer positioned such that the sponge material layer is between the cloth material layer and the plenum, and a cloth layer adjacent to the sponge material layer, the layers being joined such that the substantially impermeable layer, the plenum, and the sponge material layer are substantially enclosed between the backing layer and the cloth layer, said layers and said plenum forming a unitary disposable assembly, a fluid reservoir;

a fluid supply line connecting the fluid reservoir to the disposable plenum; and a valve assembly for regulating the flow of fluid through the supply line.

12. The mop assembly of claim 11 wherein the disposable plenum comprises a long tubular portion having said plurality of openings positioned substantially uniformly along its length and a short tubular portion about perpendicular to the long tubular portion, said short tubular portion extending upward through an opening in said second layer and connecting to said fluid supply line.

13. The mop assembly of claim 11 wherein the disposable mop is fastened to the mop head by means of an adhesive.

14. The mop assembly of claim 11 wherein the disposable mop is fastened to the mop head by means of fastener hook and loop type strips.

15. The mop assembly of claim 11 wherein the mop handle comprises a hollow tube and wherein the fluid supply line passes through said hollow tube.

16. The mop assembly of claim 11 wherein the fluid reservoir comprises a 2½ gallon plastic container.

17. The mop assembly of claim 11 further comprising a backpack for containing the fluid reservoir during use.

18. The mop assembly of claim 11 wherein the fluid supply line comprises a flexible plastic tube.

19. The mop assembly of claim 11 wherein the valve assembly comprises a stopcock valve.

* * * * *